United States Patent [19]

Zen

[11] 4,125,249

[45] Nov. 14, 1978

[54] RAILING JOINT

[76] Inventor: Giuseppe P. Zen, 3475 Pandora St., Vancouver, British Columbia, Canada, V5K 1W7

[21] Appl. No.: 842,020

[22] Filed: Oct. 14, 1977

[51] Int. Cl.[2] ..... E04B 17/14

[52] U.S. Cl. ..... 256/67; 403/189

[58] Field of Search ..... 256/67, 65; 403/187, 403/189, 246, 262

[56] References Cited

U.S. PATENT DOCUMENTS

| | | | |
|---|---|---|---|
| 3,004,751 | 10/1961 | Woodward | 256/67 |
| 3,306,586 | 2/1967 | Green | 256/67 X |
| 3,733,055 | 5/1973 | Hughes, Jr. | 256/65 X |

*Primary Examiner*—Andrew V. Kundrat

*Attorney, Agent, or Firm*—Townsend and Townsend

[57] ABSTRACT

A pivotable joint adapted to join an upright of metal railings to a top or bottom rail of the railings. The pivotable joint comprises a first member attachable to the top or bottom rail. A second member adapted to be attached to the uprights and a pivotable link between the first and second members. The joint permits substantial savings in the construction of metal railings.

7 Claims, 3 Drawing Figures

Fig. 1.
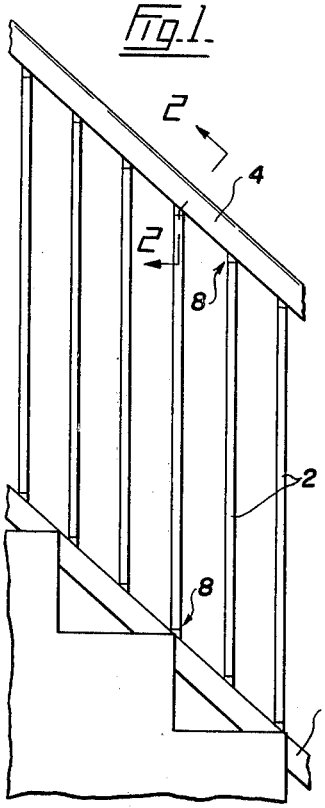
Fig. 2.
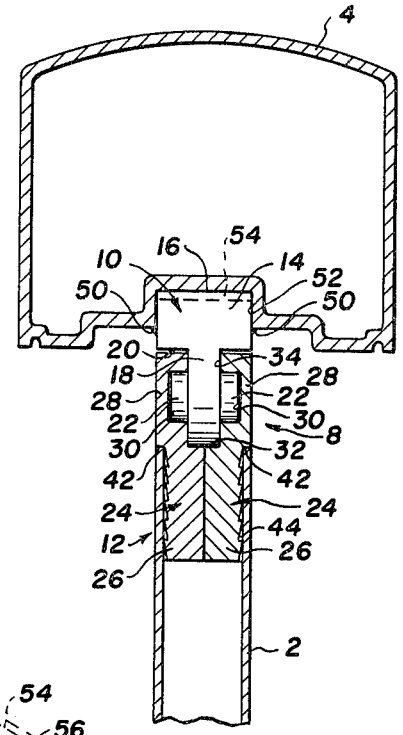
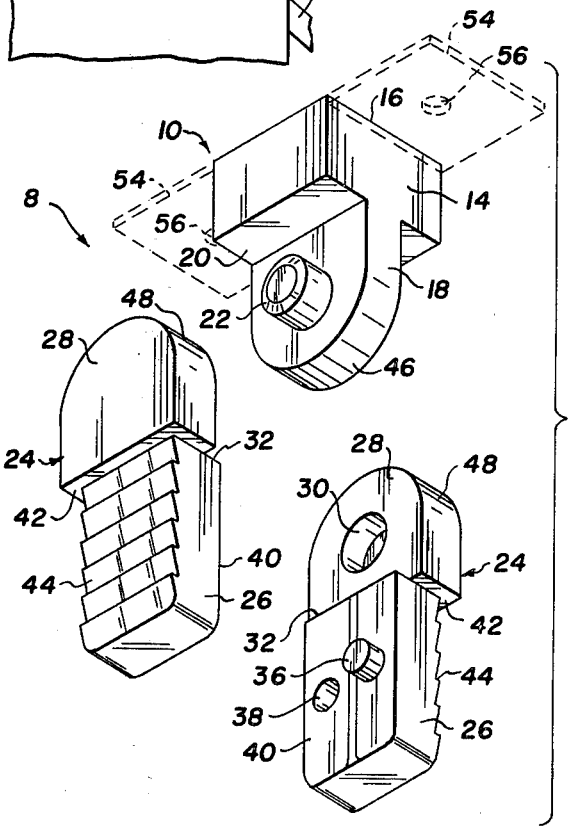
Fig. 3.

RAILING JOINT

FIELD OF THE INVENTION

This invention relates to a pivotable joint useful in the construction of metal railings. The invention also provides a length or railing adapted to be installed with no or very little welding at the site of installation.

DESCRIPTION OF PRIOR ART

In the installation of metal railing, particularly when the railing is installed inclined to the horizontal, the problem of attaching the uprights to the top and bottom rails results in considerable delay and in wastage. The traditional method of joining the uprights to the top and bottom rails is by welding. When the railing is inclined to the horizontal it is necessary to measure the required angle and to cut the upright to that angle. If an error is made in transposing the measurements to the cut then substantial waste can result. The present invention seeks to avoid this waste and also to facilitate greatly the speed of construction of such railings. It is estminated that the present invention should reduce existing production and installation costs by 30 to 40 percent.

SUMMARY OF THE INVENTION

In a first aspect the present invention is a pivotable joint adapted to join an upright of metal railings to a top or bottom rail of said railings, the pivotable joint comprising a first member attachable to the top or bottom rail; a second member adapted to be attached to the upright and a pivotable link between said first and second members.

In a further aspect the present invention is a pivotable joint adapted to join an upright of metal railings to the top or bottom rail of said railings, the pivotable joint comprising a base adapted to be welded to the top or bottom rail with a first surface in contact with said rail; a flange projecting outwardly from that surface of the base remote from the first surface; aligned cylindrical lugs extending outwardly, one from each side of the flange; a second member to engage the upright comprising two cooperating members, each co-operating member comprisng a shank to engage the upright; a bearing block attached to the shank; a recess in the bearing block to receive a cylindrical lug on said flange, whereby the base and the second member are pivotably joined.

In yet a further aspect the present invention provides a length of railing in which the uprights are attached to the tops and bottom rails by a plurality of the above pivotable joints.

BRIEF DESCRIPTION OF THE DRAWINGS

Aspects of the invention are illustrated, merely by way of example, in the accompanying drawings in which:

FIG. 1 illustrates a section of railing according to one aspect of the present invention, FIG. 2 is a section along the line 2—2 in FIG. 1 and illustrates more particularly a pivotable joint according to the invention; and FIG. 3 is an exploded view of a pivotable joint according to a preferred aspect of the invention.

DESCRIPTION OF THE PREFERRED EMBODIMENTS

FIG. 1 illustrates a set of railings comprising uprights 2 joining a top rail 4 and a bottom rail 6. Between each upright 2 and the top rail 4 and bottom rail 6 there is a pivotable joint 8. The pivotable joint 8 is illustrated in more detail in FIGS. 2 and 3. As generally indicated in those Figures, the pivotable joint 8 comprises a first member 10 that is attachable to the top rail 4 or the bottom rail 6, that is at either end of the upright 2. A second member 12 is adapted to be attached to the upright. There is means to form a pivotable link between said first and second members 10 and 12. Usually the upright 2 is hollow and the second member 12 is adapted to be retained within the upright as shown particularly in FIG. 2. However, other means of location is possible. For example the second member 10 may fit over the upright 2, particularly where the upright 2 is solid.

FIGS. 2 and 3 illustrate a preferred embodiment of the invention in which the first member 10 comprises a base 14 adapted to be welded to the top rail 4 or the bottom rail 6 with a first surface 16 in contact with the rail 4 or 6. A flange 18 projects outwardly from that surface 20 of the base 14 remote from the first surface 16. Aligned cylindrical lugs 22 extend outwardly from the flange 28, one from each side. The second member 12, which engages theuprights 2, comprises, in this preferred embodiment, two similar co-operating members 24. Each co-operating member 24 comprises a shank 26 to engage the upright 2. A bearing block 28 is attached to the shank 26. A recess 30 in the bearing block 28 receives a cylindrical lug 22 on said flange 18. By this means the base 14 and the second member 12 are pivotably joined. In the preferred illustrated embodiment each second member 12 includes a shoulder 32 formed between said shank 26 and said bearing block 28. Each shoulder 32 is about half the width of a lug 22 so that a lug-receiving recess 34 is defined between the bearings blocks 28 when the shanks 26 are in contact with each other in their useful position, for example as illustrated in FIG. 2.

As illustrated in particular in FIG. 3 each shank 26 has a small lug 36 and a recess 38 formed at a first surface 40. The lug 36 of one shank 26 engages the recess 38 of the other shank 26 to fix the relative positions of the shanks 26. This permits construction of the second member 12 when the second member 12 is made of two similar co-operating members 24. The two shanks 26 can be placed together and then tapped into position in the interior of the upright 2 while maintaining the lug-receiving recesses 34 in the bearing block 28 in alignment. It should also be noted in FIGS. 2 and 3 that there are under shoulders 42 formed on each of said co-operating members 24 again to control the depth of insertion of the second member 12 into the upright 2.

In order to facilitate location and retention of the shank 26 within the upright 2 the shanks 26 are provided with serrations 44 upwardly and outwardly extending that restrict ease of withdrawal of the shanks 26 from within the interior of the uprights 2.

In order to make the pivotable joint 8 according to the invention of the least possible height it is desirable to round the flanges 18 remote from the base 14 as illustrated at 46. Similarly each bearing block 28 is rounded remote from its attached shank 26 as shown at 48.

The pivotable joint will be made of the metal from which the railings are made. The metal is usually steel or aluminum.

A piece of railing according to a further aspect of the present invention is illustrated in FIG. 1. It should be noted from FIG. 2 that the base 14 is welded at 50 to the top rail 4. The same arrangement may be used to attach the pivotable joint 8 at the lower end to the bottom rail 6. It is desirable that the top rail 4 and the bottom rail 6 be formed with a channel 52 as illustrated in FIG. 2 to receive the base 14. It should also be noted that weld 50 need not be used. Block 14 can be screwed to the top rail 4 (or to a bottom rail) by use of the flanges 54 down in dotted outline in FIG. 3 which can receive screws through holes 56.

It is envisaged that the railing illustrated in FIG. 1 can be sold in predetermined lengths and cut to length at the site of installtion. Simple attachment of the ends of such a piece of railing to mounted end pieces will be sufficient. The railing may then be inclined to the required angle and the pivotable joints 8 will ensure that the uprights 2 remain vertical with a minimum amount of labour. It should be noted that the illustrated joint can also be used to attach the top rail and bottom rail to the mounted end pieces. Normally a closure piece will fit inside the hollow rail 4 or 6 with a recess to receive shanks 26. Typcially a joint for mounting the top and bottom rails 4 and 6 to the mounted end pieces will be larger than the joint 8 for the uprights 2. It is envisaged that such a railing could be installed within minutes. By far the most time-consuming job of the installation of such a rail is the installment of the end pieces, a job that is already necessary with existing rails.

The cylindrical lugs 22 may be replaced by a pin to be inserted through both bearing blocks 28 and the flange 18. The flange 18 and the bearing blocks 28 will be provided with clear holes that align with each other to receive the pivot pin. However, the illustrated embodiment is the preferred form of the invention.

I claim:

1. A pivotable joint adapted to join an upright of metal railings to a top or bottom rail of said railings, the pivotable joint comprising:

a base adapted to be welded to the top or bottom rail with a first surface in contact with said rail;

a flange projecting outwardly from that surface of the base remote from the first surface;

aligned cylindrical lugs extending outwardly, one from each side of the flange;

a second member to engage the upright comprising two similar co-operating members, each co-operating member comprising a shank to engage the upright;

a bearing block attached to the shank;

a recess in the bearing block to receive a cylindrical lug on said flange, whereby the base and the second member are pivotably joined.

2. A pivotable joint as claimed in claim 1 in which each second member includes a shoulder formed between said shank and said bearing block, each shoulder being about half the width of said lug so that a lug-receiving recess is defined between said bearing blocks when said shanks are in contact with each other in their useful position.

3. A pivotable joint as claimed in claim 1 in which each shank has a lug and a recess formed at a first surface, the lug of one shank engaging the recess of the other to fix the relative positions of the shanks.

4. A pivotable joint as claimed in claim 3 to be used with hollow uprights in which there are serrations formed on each shank on each surface remote from said first surface, said serrations extending upwardly outwardly to engage the interior of the upright.

5. A pivotable joint as claimed in claim 1, in which the flange is rounded remote from the base and each bearing block is rounded remote from its attached shank.

6. A pivotable joint as claimed in claim 1 made from aluminum or steel.

7. A length of railing adapted to be installed without welding at the site of installation, said railing comprising a top rail;

a bottom rail;

a plurality of hollow uprights extending between said top and bottom rail, each upright being attached to the top rail and to the bottom rail by a pivotable joint comprising:

a base at each end of each upright, one base welded to the top rail the other welded to the bottom rail;

a flange projecting outwardly from each base away from the adjacent rail;

aligned cylindrical lugs on each side of the flange;

second members attached to the upright at each end and each comprising two co-operating members, each cooperating member comprising a shank that fits inside the upright;

a hub member attached to the shank;

a shoulder formed between the shank and the hub member, about half the width of said flange, to define a flange-receiving recess between a pair of hub members; and a recess formed in each hub member to receive a cylindrical lug on said flange.

* * * * *